US005127689A

United States Patent [19]

Jarvis

[11] Patent Number: 5,127,689

[45] Date of Patent: Jul. 7, 1992

[54] SECURITY APPARATUS FOR SLIDING WINDOW OR DOOR

[76] Inventor: Ralph K. Jarvis, 1447 W. 4020 South, Salt Lake City, Utah 84123

[21] Appl. No.: 727,100

[22] Filed: Jul. 9, 1991

Related U.S. Application Data

[63] Continuation-in-part of Ser. No. 707,709, May 30, 1991.

[51] Int. Cl.[5] ..... E05C 17/04

[52] U.S. Cl. ..... 292/339; 292/DIG. 46

[58] Field of Search ..... 292/338, 339, 342, 343, 292/262, DIG. 46

[56] References Cited

U.S. PATENT DOCUMENTS 3,352,586 11/1967 Hakanson ..... 292/DIG. 46 X
3,975,041 8/1976 Edison ..... 292/DIG. 46 X
4,105,233 8/1978 Levey ..... 292/DIG. 46 X
4,822,084 4/1989 Fox ..... 292/DIG. 46 X
4,826,225 5/1989 Styles ..... 292/305 X
4,895,471 1/1990 Geltz et al. ..... 403/104
5,015,022 5/1991 McGuire ..... 292/DIG. 46 X

*Primary Examiner*—Richard E. Moore
*Attorney, Agent, or Firm*—Trask, Britt & Rossa

[57] ABSTRACT

A security device for preventing removal of a sliding sash from a window, and including an elongated member having a tapered end or wedge at one end thereof for insertion into the gap between the top of the sash and the window frame, and a supporting assembly for maintaining the tapered end or wedge in the gap. In lieu of the supporting assembly, the elongated member may be adjustable in length for bracing the end opposite the wedge or taper against the window frame.

20 Claims, 3 Drawing Sheets

SECURITY APPARATUS FOR SLIDING WINDOW OR DOOR

BACKGROUND OF THE INVENTION

This application is a continuation-in-part of U.S. Pat. Ser. No. 07/707,709, filed May 30, 1991.

1. Field of the Invention

The present invention relates to devices for preventing forced entry into a home or other building through a window, and is specifically applicable to windows of the type having a sash which slides within a frame set in the wall of the building.

2. State of the Art

Windows are a favored means of unwanted entry into structures, as they present far less of a challenge to burglars than doors. Moreover, windows may normally be found in unlighted or otherwise hidden portions of a structure's exterior, and so present an excellent opportunity for unobserved entry.

A window type which presents particular security problems is the so-called "sliding" window, in which a rectangular sash comprising upper and lower horizontal rails and right- and left-hand vertical struts encompass a window pane, the sash being laterally moveable in upper and lower horizontal tracks in a window frame, which also includes vertical side tracks extending between the upper and lower tracks. In either case, it is common for window manufacturers to include a snap-type or pivot-type catch which, when the window is completely closed, prevents horizontal sash movement.

The problem with these prior art catches lies in an inherent design flaw in sliding windows which is intentionally built in by manufacturers for ease of window assembly as well as for ease of sash removal for cleaning of the exterior surface of the window pane and screen installation. This flaw resides in the excess clearance or gap between the top and bottom window frame tracks, which is necessary to permit the sash to be inserted upwardly into the top track at a slight angle to the vertical, tilted to a vertical position, and dropped into the lower track to its normal operating position. The same excess clearance or gap permits a burglar to insert a hook under the lower rail of a moveable sash, or even (in cheaper windows) to merely press upwardly on the window pane with his hands and rotate the sash bottom toward the interior of the building, lower the top sash rail out of the top track, and remove the sash from the window.

Aftermarket security devices commonly do not address this type of unwanted entry, as they comprise locking bars pivoted to the frame at one end and resting in a yoke secured to the sash at the other, spring-loaded horizontal locking bars, clips which grip the track walls, or simply a length of broom handle or other piece of wood sized to fit the track in which the sliding sash rides when the sash is in its closed position. Other devices, which may prevent sash removal, are generally more complex, permanently installed and require drilling into the sash, the frame, or both, for installation. In addition, many of the more sophisticated devices on the market include keyed locks which present safety problems should the window be locked and the occupant of the room be lacking the key in event of a fire, preventing exit from the room.

SUMMARY OF THE INVENTION

In contrast to the prior art, the security apparatus of the present invention provides a simple, portable and inexpensive but extremely effective means for securing a sliding sash window against forced entry, and without creating safety problems for the building occupants.

The present invention comprises first elongated member including a tapered end adapted for insertion in the gap between the moveable sash and the upper window frame track, and means for maintaining the elongated member in the frame where the tapered end is inserted in the gap.

In the preferred embodiments, first, second and third elongated members are employed in the apparatus. The first member is placed at one oblique angle in the window frame with the tapered end thereof in the top track gap between the moveable sash and the base of the top window track, the other end thereof extending toward the vertical side track forming the side of the frame. The second member is placed vertically in the side track with the top thereof adjacent the lower end of the first member, and the third member is placed with one end adjacent the window sash in the bottom track, and adjusted in length or orientation to maintain the second member in the side track of the window frame.

In an alternative embodiment of the invention, only first and second members are employed, the second member is disposed in the side track of the frame, and is biased or otherwise maintained in the track and in cooperation with the lower end of the first member.

In yet another preferred alternative embodiment of the invention, only a first elongated member is employed, the tapered end thereof being characterized as a wedge secured to one end of the member, the member being extendable and retractable so as to cause the end thereof opposite the wedge to contact the side track of the window, or the corner junction between the side track and the bottom track to maintain the wedge in place. This embodiment of the invention, in particular, is well suited for application to large windows and to sliding doors and, due to the nature of the design, a single size will accommodate a wide range of window dimensions.

The moveable sash is thereby secured against both horizontal and vertical movement, while the security apparatus may be removed in a matter of seconds to permit the sash to slide to an open position.

DESCRIPTION OF THE PREFERRED EMBODIMENTS

Figure 1:
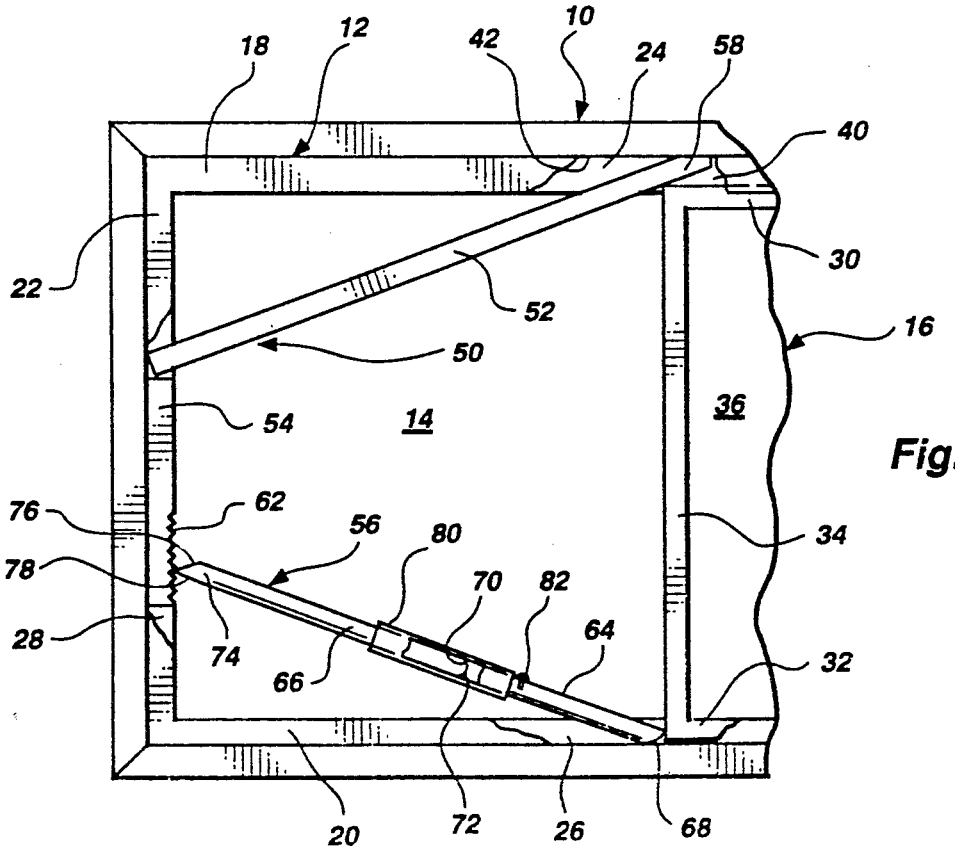
FIG. 1 comprises an elevation of a sliding sash window having a first preferred embodiment of the present invention installed therein.

Referring to FIG. 1 of the drawings, the left-hand side (as viewed from a building interior) of window 10 including frame 12, fixed sash 14 and moveable sash 16, is depicted. The major elements of frame 12 comprise upper and lower tracks 18 and 20, respectively, and left- and right-hand side tracks, left-hand side track 22 only being shown. Tracks 18, 20 and 22 are of generally "U"-shaped cross-section and define channels 24, 26 and 28, respectively.

Moveable sash 16 includes horizontal top and bottom rails 30 and 32, and connecting left- and right-hand vertical struts, left-hand strut 34 only being shown, which form a perimeter to carry pane of glass 36.

As can easily be seen, there is a substantial gap 40 between the base 42 of upper track 18 and top rail 30, to permit moveable sash 16 to be installed in frame 12 and to be removed for cleaning and screen installation and removal.

When moveable sash 16 is in its closed position, that is to say all way to the right in frame 12, first preferred embodiment 50 of the security apparatus of the present invention may be installed therein. Apparatus 50 includes first, second and third elongated members 52, 54 and 56, which are preferably of wood or other said material and of generally square or rectangular cross-section. First member 52 includes a tapered or beveled end 58 on one end, while the other end 60 may be of any suitable configuration. Second member 54 includes a grooved or serrated surface 62 on one side thereof. Third member 56 includes first and second segments 64 and 66, first segment 64 including an arcuate outer end 68 and an arcuately recessed inner end 70. Second segment 66 includes an arcuate inner end 72 adapted by radius to be received in recessed end 70 of first segment 64, and a pointed outer end 74 having a first taper 76 and second taper 78 on opposite sides thereof. Tubular sleeve 80 slides over segments 64 and 66, and is restrained by contact with stop screw 82.

To install apparatus 50 in window 10, first member 52 is placed with tapered end 58 located in upper channel 24 and inserted in gap 40, and lower end 60 in side track 22. Second member 54 is placed vertically in side channel 28 below and abutting lower end 60 of first member 52, and with serrated surface 62 facing inwardly toward the center of the window 10. Third member 56 is then installed by placing arcuate first segment outer end 68 in lower channel 26 adjacent left-hand strut 34 of sash 16, and rotating third member 56 downwardly (counter-clockwise) using outer end 68 as a pivot point until second segment outer pointed end 74 is adjacent serrated surface 62. Sleeve 80 is then slid toward serrated surface 62 to permit third member to buckle or fold in the plane of window 10 about the ball-and-socket joint 84 formed by the adjacent inner ends 70 and 72 of first and second segments 64 and 66. Continued downward rotational movement of the folded, and thus shorter, third member 56 is continued until the straightening of third member 56 will result in the pointed outer end 74 being pressed firmly into a horizontal recess of serrated surface 62 of second member 54, sleeve 80 then being dropped back over ball-and-socket joint 84 to rigidize third member 56 and thus complete the installation of apparatus 50. It should be noted that segments 64 and 66 may be joined at their inner ends by a hinge means, such as is described hereafter with respect to FIGS. 2 and 3, and sleeve 80 employed in the manner previously described to rigidize third elongated member 56. Of course, third elongated member 56 could also comprise a telescoping instead of a folding structure, of the type described below with reference to FIGS. 2 and 3. In addition, if second elongated member is sized so that serrated surface protrudes inwardly of the edge of side track 22, third elongated member 56 may be of one-piece construction, and utilized by simply placing end 68 in channel 26, and swinging pointed end 74 into one of the grooves or serrations in surface 62 to maintain second elongated members 54 in place.

It should be noted that the serrated surface 62 on second member 54 provides a means of adjusting apparatus 50 to different size windows, and the two tapers 76 and 78 on second segment 66 of third member 56 provide a means, by 180° rotation of the segment about its axis, to accommodate different angular orientations of third member 56 which may be occasioned by installation in different size windows.

Figure 2:
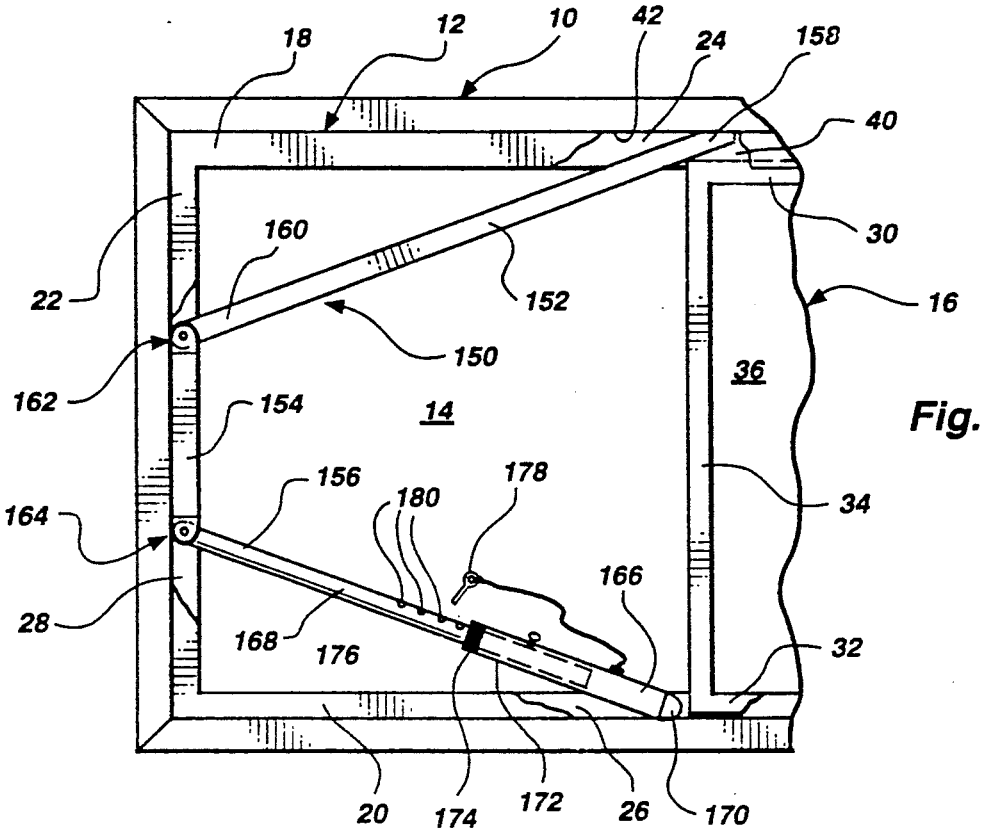
FIG. 2 comprises an elevation of a sliding sash window having a second preferred embodiment of the invention installed therein.
Figure 3:
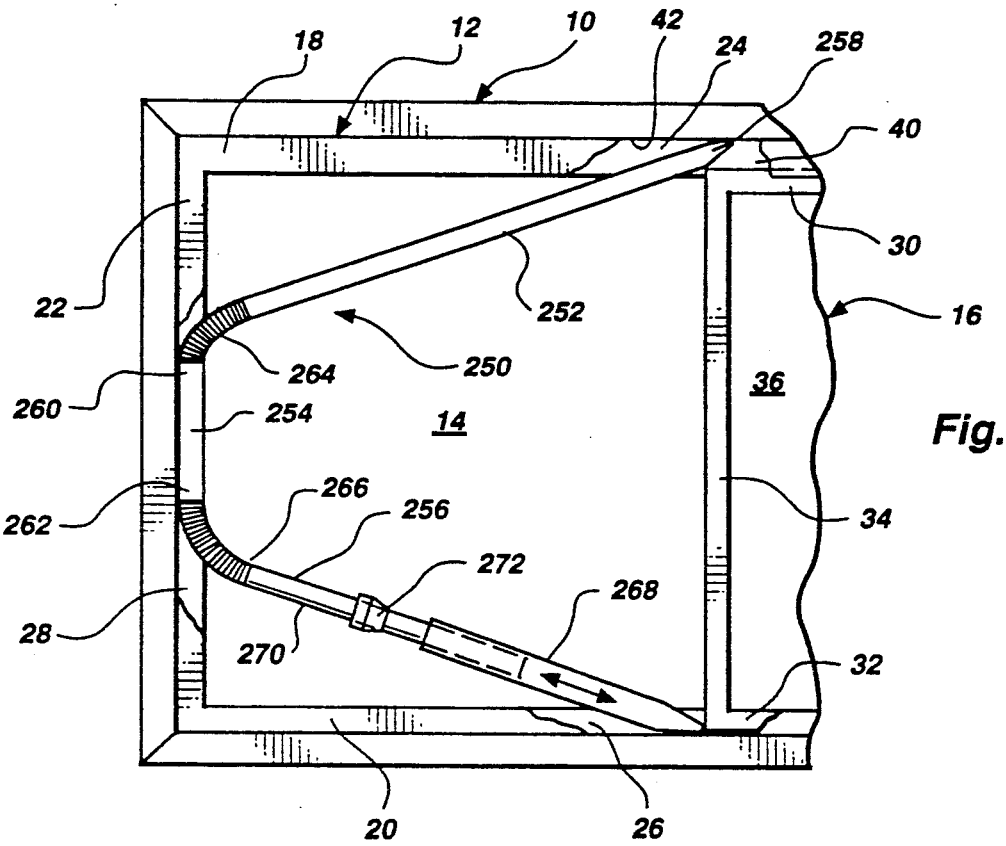
FIG. 3 comprises an elevation of a sliding sash window having a third preferred embodiment of the invention installed therein.
Figure 4:
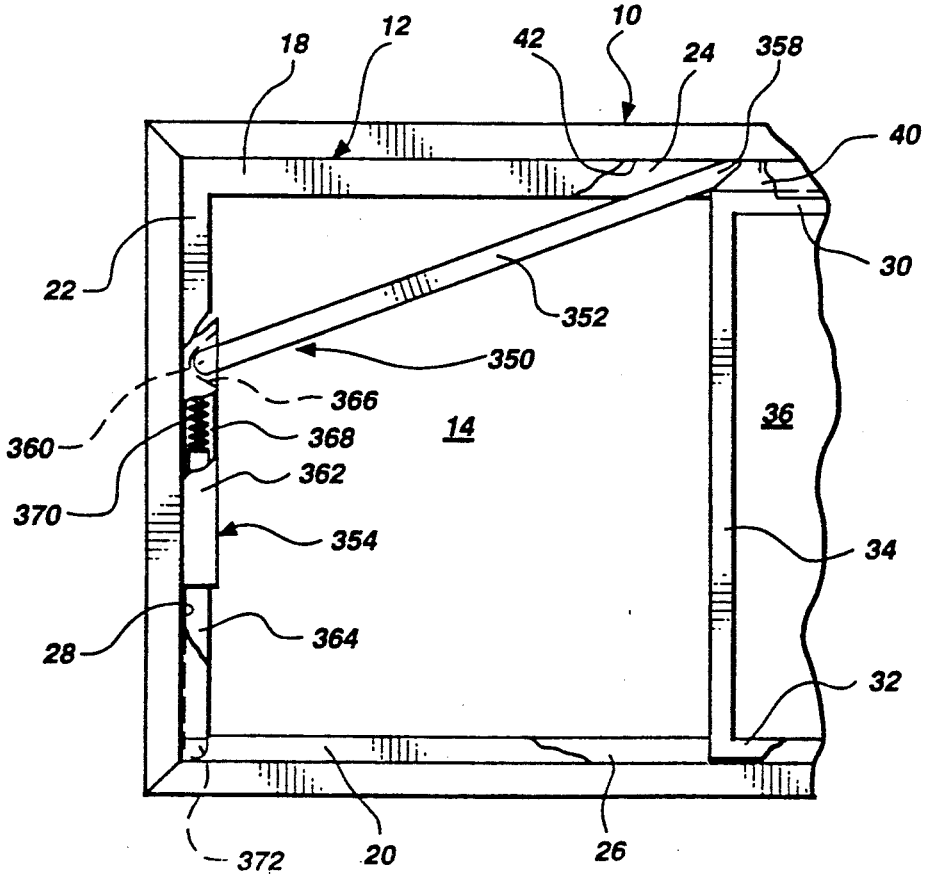
FIG. 4 comprises an elevation of a sliding sash window having an alternative embodiment of the invention installed therein.

Referring now to FIGS. 2, 3 and 4 of the drawings, window 10 is again illustrated, the elements thereof being identified with the same reference numerals previously employed in conjunction with the description of FIG. 1.

In FIG. 2, a second preferred embodiment 150 of the apparatus of the present invention is depicted installed in window 10. Apparatus 150 includes first, second and third members 152, 154 and 156, which may be of any suitable cross-section, and of tubular stock. First member 152 includes tapered end 158, and is hinged at its lower end 160 to the top of second member 154 by a yoke-type or other suitable first hinge means 162, the bottom of second member 154 being hinged at its lower end to third member 156 by another suitable second hinge means 164. Third member 156 includes first and second segments 166 and 168, first segment 166 including a ball-type or other suitable cushion or pad 170 at its outer end, the inner end 172 enveloping second segment 168 in a telescoping manner. A means to mutually fix segments 166 and 168 and resultingly the length of third member 156, may be provided by any suitable structure, FIG. 2 illustrating (for use in the alternative) rotatable friction collar 174, set screw 176, and pin 178 in cooperation with apertures 180. Installation of apparatus 150 is effected by placing tapered end 158 of first member 152 in gap 40, second member 154 then depending vertically from hinge means 162 in channel 28, and third member 156 rotating clockwise downwardly from second hinge means 164 into track 26. The length of third member 156 is then adjusted to place pad 170 adjacent left strut 34 of sash 16, and then the fixing means is tightened or otherwise activated to fix apparatus 150 in the position shown in FIG. 2.

FIG. 3 depicts a third preferred embodiment 250 of the invention, comprising first, second and third members 252, 254 and 256, preferably formed of tubular stock. First member 252 again includes a tapered end 256, and first and third members 252 and 256 are secured to the upper and lower ends 260 and 262, respectively, of second member 254 by resilient or bendable joints 264 and 266. Joints 264 and 266 (which serve as hinge means) may comprise coil springs secured to the members, resilient rubber elements, spring steel plates, or molded corrugated segments comparable to vacuum cleaner hose. The corrugated segments might be integrally molded should first, second and third members be fabricated from a plastic compound as a single unit. Third member 256 includes first and second segments 268 and 270, first segment telescopingly accommodating second segment 270 in an adjustable manner. Sliding friction collar 272 on the exterior of second segment 270 may be used to mutually fix the two segments, one of the means used in FIG. 2 may be employed, or other suitable means known in the art utilized. Installation of apparatus 250 is effected in substantially the same manner as apparatus 150. It should also be understood that only first and third elongated members may be employed in the FIG. 3 embodiment, second member 254 being combined within a single, long bendable joint.

FIG. 4 depicts an alternative embodiment 350 of the apparatus of the invention, embodiment 350 including only a first member 352 and a second member 354. First member 352 includes tapered end 358, while the other end 360 is of rounded configuration. Second member 354 is comprised of first and second segments 362 and 364, first segment 362 including socket 366 adjacent its upper end, socket 366 being radiused to accommodate end 360 of first member 352. Below socket 366, cavity 368 accommodates spring 370 and the upper end of second segment 364 which is enveloped in a telescoping manner. The lower end of second segment 364 includes pad or cushion 372. To install apparatus 350, tapered end 358 of first member 352 is inserted in gap 40, while second member 354 having rounded end 360 of first member 352 in its socket is disposed in channel 28. Spring 370 extends second member 354 upwardly in channel 28 until a stable position is reached. Alternatively, a hinge means in the vein of a yoke-type hinge, a bendable segment or a permanent ball-and-socket joint may be employed between first and second members 352 and 354. Furthermore, the segments of second members 354 may be positively securable at a given length using means previously described with respect to the embodiments shown in FIGS. 2 and 3.

Figure 5:
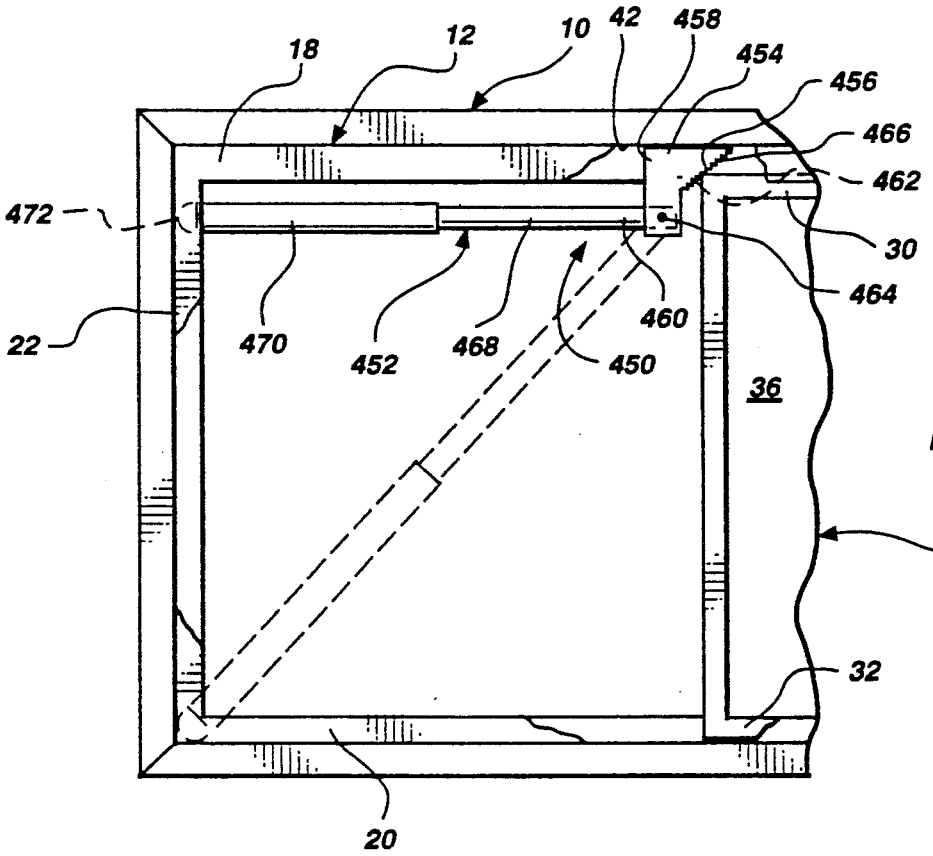
FIG. 5 comprises an elevation of a sliding sash window having a first version of an alternative and preferred embodiment of the invention installed therein.

FIG. 5 depicts a first version 450 of a preferred alternative embodiment of the apparatus of the invention, apparatus 450 including only a first member 452 having a tapered end or preferably, as shown, a wedge 454 associated with one end thereof. In apparatus 450, wedge 454 is of hollow construction, being formed by molding or sheet metal bending in a configuration having a bearing surface 456 having two flanges or ears 458 extending therefrom at right angles, one end 460 of member 452 being received in cavity 462 within the wedge and being pivotally mounted thereto by hinge pin 464, which may be upset at the ends thereof or have other means applied thereto to maintain the pin in place. If desired, bearing surface 456 may be formed as or covered by a knurled or serrated surface 466, of rubber or other elastomer, to frictionally engage the top rail 30 of movable sash 16. Member 452 is of telescopic configuration, comprising first and second segments 468 and 470, the former being received within the latter. Means to mutually fix segments 468 and 470, and thus the length of member 452, are provided by any suitable structure, such as have been previously disclosed herein. However, it is also contemplated that means such as are employed in certain designs of tension rods for curtains, shower curtains, and closet rods may also be employed. For example and not by way of limitation, a combination friction and rotational adjustment mechanism marketed and sold as the Safe Rod TM tension rod by Zenith Products Corporation and purportedly covered by U.S. Pat. No. 4,895,471, the disclosure of which is hereby incorporated herein by this reference, may be employed to adjust and fix the length of member 452. Another alternative is a telescoping tension rod assembly having a spring and a movable stop within the outer segment, the spring being disposed between the inner segment and the stop, so as to provide some resiliency in the member for installation in the window after member 452 is adjusted to substantially the desired length. Furthermore, the segments 468 and 470 may have cooperating screw threads so as to permit length adjustment via mutual rotation of the segments.

While it is possible to install apparatus 450 parallel to and substantially within upper track 18, it is preferred for convenience of installation and removal that wedge 454 be configured so as to drop the hinge point below upper track 18 when installed, as shown in FIG. 5. The outer end of segment 470 may be capped with a suitable rubber or elastomeric pad or stop 472. The wedge design of FIG. 5 also makes it easier to accommodate an alternative installation orientation for member 452, shown in broken lines thereon, wherein member 452 is deployed obliquely in window frame 12 and pad or stop 472 is disposed in the corner defined by the junction of side track 22 and bottom track 20 of window 10.

Figure 6:
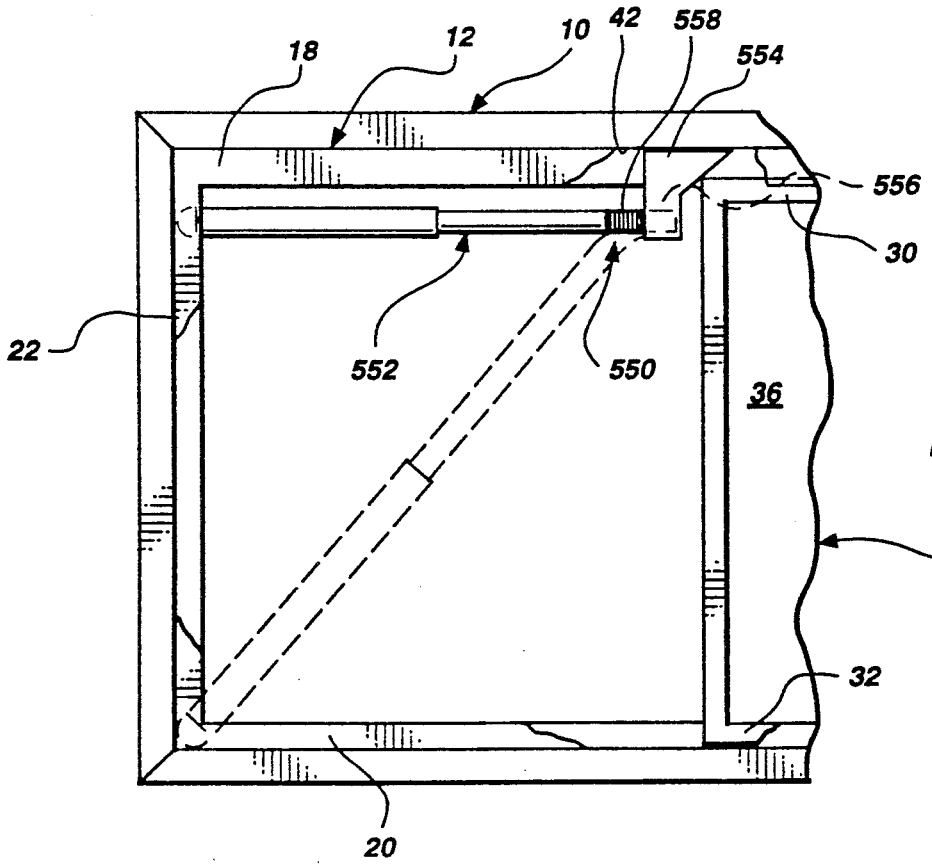
FIG. 6 comprises an elevation of a sliding sash window having a second version of an alternative and preferred embodiment of the invention installed therein.

FIG. 6 discloses a second version 550 of an alternative preferred embodiment of the invention, including an elongate member 552 of substantially the same construction as member 452, but which is non-pivotally secured to a wedge 554 at one end thereof, being received in socket 556 in the wedge. While not as versatile as apparatus 450, in that the absence of a pivot limits the range of window sizes in which the apparatus may be installed, it is nonetheless significantly less expensive to configure the apparatus of the invention in this manner. Aside from the fixed wedge connection, the remainder of apparatus 550 may be the same as apparatus 450, and so will not be described in detail.

It should also be recognized that apparatus 550 may include a bendable element 558 between the end of first elongated member 552 and wedge 554, bendable element 558 comprising a coil spring, leaf spring, resilient tube or solid elastomer, or any other suitable means. The inclusion of bendable element 558 enhances the versatility of apparatus 550 in the same manner as the pivotal wedge mounting in apparatus 450, to permit an alternative oblique installation orientation (shown in broken lines in FIG. 5) in smaller windows.

Of course, as mentioned above, the apparatus of the present invention is also suitable for installation in sliding doors, it being within the ability of one skilled in the art to size apparatus of the invention to accommodate the larger door structure.

It should be understood that several different sizes of the apparatus of the invention may be necessary to accommodate the wide range of window sizes on the market, sizing of the apparatus members being within the skill of those practicing the art. Moreover, it is also contemplated that features illustrated with respect to one of the embodiments disclosed herein may be transposed or substituted into another without departing from the spirit and scope of the invention as set forth in the following claims. Finally, it is contemplated that the first elongated member may be constructed so as to be adjustable in length as previously disclosed herein with respect to the third elongated member.

What is claimed is:

1. A security apparatus for a window or door having a frame defined by parallel upper and lower tracks and at least one side track perpendicular to said upper and lower tracks, a sash slidable within said upper and lower tracks, and a gap between the top of said sash and said frame, comprising:

a first elongated member having a tapered end adapted for insertion into said gap; and means for maintaining said first elongated member in said frame when said tapered end thereof is inserted in said gap, said maintaining means comprising second and third elongated members, said second elongated member adapted for accommodation in said side track in supporting relationship to said first elongated member, and said third elongated member adapted to maintain said second elongated member in said side track in said supporting relationship.

2. The apparatus of claim 1, wherein said second elongated member includes first engagement means and said third elongated member includes second engagement means at one end thereof adapted to cooperate with said first engagement means.

3. The apparatus of claim 1, wherein said third elongated member comprises first and second longitudinally abutting segments, one of said segments having an arcuate recess at its inner end, and the other having an arcuate end adapted by radius for reception in said recess, and further includes means for fixing said segments in colinear relationship.

4. The apparatus of claim 2, wherein said third elongated member comprises first and second longitudinal abutting segments joined by hinge means, and further includes means for fixing said segments in colinear relationship.

5. The apparatus of claim 2, wherein said third elongated member is selectively adjustable in length.

6. The apparatus of claim 2, wherein said third elongated member is of unitary construction.

7. The apparatus of claim 1, wherein said first elongated member and said third elongated member are secured to said second elongated member at the ends thereof, and said third elongated member is selectively adjustable in length.

8. A security apparatus for a window or door having a frame defined by parallel upper and lower tracks and at least one side track perpendicular to said upper and lower tracks, a sash slidable within said upper and lower tracks, and a gap between the top of said sash and said frame, comprising:

a first elongated member having a tapered end adapted for insertion into said gap; and means for maintaining said first elongated member in said frame when said tapered end thereof is inserted in said gap, said means for maintaining comprising a second elongated member adapted for accommodation in said side track in supporting relationship to said first elongated member.

9. The apparatus of claim 8, wherein said second elongated member is adjustable in length.

10. The apparatus of claim 9, wherein said second elongated member is biased in a direction to extend said adjustable length.

11. The apparatus of claim 8, wherein said first elongated member is supported by said second elongated member via hinge means.

12. A security apparatus for a window or door having a frame defined by parallel upper and lower tracks and at least one side track perpendicular to said upper and lower tracks, a sash slidable within said upper and lower tracks, and a gap between the top of said sash and said frame, comprising:

a first adjustable length elongated member having wedge means disposed at one end thereof adapted for insertion into said gap; and means for maintaining said first elongated member in said frame when said wedge means is inserted in said gap, said means for maintaining comprising means for substantially fixing said adjusted length.

13. The apparatus of claim 12, wherein said wedge means is pivotally secured to said one end of said first elongated member.

14. The apparatus of claim 13, wherein said wedge means is hollow, said one end of said first elongated member extends thereinto, and said pivotal securement is provided by a pin extending laterally through said one end and into said wedge means on each side thereof.

15. The apparatus of claim 12, wherein said wedge means includes a bearing surface having knurls or serrations thereon.

16. The apparatus of claim 12, wherein said wedge means is fixedly secured to said one end of said first elongated member.

17. The apparatus of claim 16, wherein said wedge means includes a socket means for receiving said one end of said first elongated member therein.

18. The apparatus of claim 12, wherein said wedge means and said one end of said first elongated member are secured via an intermediate bendable element.

19. The apparatus of claim 18, wherein said intermediate bendable element is resiliently bendable.

20. The apparatus of claim 12, wherein said adjustable length first elongated member is telescopically adjustable.

* * * * *